US008584928B2

(12) United States Patent
Keissner

(10) Patent No.: US 8,584,928 B2
(45) Date of Patent: Nov. 19, 2013

(54) BOX TEMPLATE WITH INTEGRATED CORNER PROTECTORS

(75) Inventor: Hanko Keissner, Salt Lake City, UT (US)

(73) Assignee: Packsize LLC, Salt Lake City, UT (US)

( * ) Notice: Subject to any disclaimer, the term of this patent is extended or adjusted under 35 U.S.C. 154(b) by 274 days.

(21) Appl. No.: 13/059,630

(22) PCT Filed: Aug. 18, 2009

(86) PCT No.: PCT/US2009/054147
§ 371 (c)(1),
(2), (4) Date: Apr. 26, 2011

(87) PCT Pub. No.: WO2010/022042
PCT Pub. Date: Feb. 25, 2010

(65) Prior Publication Data

US 2011/0186618 A1 Aug. 4, 2011

Related U.S. Application Data

(60) Provisional application No. 61/089,991, filed on Aug. 19, 2008.

(51) Int. Cl.
*B65D 5/44* (2006.01)

(52) U.S. Cl.
USPC ..... 229/160; 206/591; 229/174

(58) Field of Classification Search
USPC ..... 229/160, 169, 174, 186, 191; 206/453, 206/521, 586, 591, 592
See application file for complete search history.

(56) References Cited

U.S. PATENT DOCUMENTS

| | | | |
|---|---|---|---|
| 1,200,522 | A | 10/1916 | Richardson |
| 1,234,917 | A | 7/1917 | McClay |
| 1,703,042 | A | 3/1923 | Kondolf |

(Continued)

FOREIGN PATENT DOCUMENTS

| | | |
|---|---|---|
| EP | 0621194 | 10/1994 |
| EP | 1211192 | 6/2002 |

(Continued)

OTHER PUBLICATIONS

WebIndia123 "Box Making—Square Shaped Box", http://www.webindia123.com/craft/asp/craft.asp?c_id=166, Copyright 2000.

(Continued)

*Primary Examiner* — Gary Elkins
(74) *Attorney, Agent, or Firm* — Workman Nydegger

(57) ABSTRACT

A box template formed of a sheet of material defines a foldable box having at least four side surfaces, a top surface, and a bottom surface. The box template also includes a definition of corner protector sections integrally formed with the foldable box. The corner protector sections are configured to be folded to protect an object placed inside the foldable box. The top surface and bottom surface may each include at least two surfaces that are integrally formed with, and connected to, two of the side surfaces. The corner protector sections may be integrally formed with, and connected to, the other two sides of the four side surfaces. The corner protector sections are configured with a plurality of identifiable sections that may be folded in order to create corner protectors. Four corner protector sections may be integrally formed with the foldable box so as to define eight corner protectors.

20 Claims, 8 Drawing Sheets

(56) References Cited

U.S. PATENT DOCUMENTS

| | | | | | |
|---|---|---|---|---|---|
| 1,722,422 | A | | 7/1928 | Johnson | |
| 2,185,544 | A | | 8/1933 | Darragh | |
| 1,996,965 | A | * | 4/1935 | Keppler | 229/160 |
| 2,277,717 | A | | 3/1942 | Sackett | |
| 2,295,141 | A | | 9/1942 | Van Wingen | |
| 2,399,537 | A | | 5/1944 | Belden | |
| 2,832,270 | A | | 2/1955 | Pierce, Jr. | |
| 2,709,032 | A | * | 5/1955 | Ritchie | 229/191 |
| 2,857,090 | A | * | 10/1958 | Fallert | 229/160 |
| 3,003,676 | A | | 10/1961 | De Nola | |
| 3,143,937 | A | | 8/1964 | Martin | |
| 3,158,307 | A | | 11/1964 | Mayer | |
| 3,162,351 | A | * | 12/1964 | Rudofski | 229/191 |
| 3,184,136 | A | * | 5/1965 | Forbes, Jr. | 229/191 |
| 3,221,973 | A | | 12/1965 | Kalbrener | |
| 3,268,147 | A | | 8/1966 | Burger | |
| 3,443,684 | A | | 5/1969 | Taylor | |
| 3,482,759 | A | | 12/1969 | Ortiz | |
| 3,586,233 | A | | 6/1971 | McCulloch | |
| 3,690,222 | A | | 9/1972 | Schroeder | |
| 3,832,826 | A | | 9/1974 | Ullman | |
| 3,843,038 | A | | 10/1974 | Sax | |
| 3,923,234 | A | * | 12/1975 | Lund, Jr. | 206/586 |
| 3,948,152 | A | | 4/1976 | Nolan | |
| 3,957,196 | A | | 5/1976 | Kellerman | |
| 4,027,817 | A | | 6/1977 | Fremion | |
| 4,094,451 | A | | 6/1978 | Wescoat | |
| RE30,325 | E | | 7/1980 | Waldbauer | |
| 4,211,356 | A | | 7/1980 | Tsuchiya | |
| 4,215,522 | A | | 8/1980 | Clift | |
| 4,264,200 | A | | 4/1981 | Tickner et al. | |
| 4,326,633 | A | * | 4/1982 | Schillinger et al. | 206/586 |
| 4,399,915 | A | | 8/1983 | Sorenson | |
| 4,522,016 | A | | 6/1985 | Dirico | |
| 4,608,038 | A | | 8/1986 | Virta | |
| 4,838,468 | A | | 6/1989 | Lesse | |
| 4,972,954 | A | | 11/1990 | Dickie | |
| 5,058,872 | A | | 10/1991 | Gladow | |
| 5,115,625 | A | | 5/1992 | Barbulesco | |
| 5,372,259 | A | | 12/1994 | Suzuki | |
| 5,374,326 | A | | 12/1994 | Marchetti | |
| 5,501,339 | A | * | 3/1996 | Suzuki et al. | 206/586 |
| 5,823,352 | A | | 10/1998 | Mena | |
| 5,836,498 | A | | 11/1998 | Turek | |
| 5,975,303 | A | | 11/1999 | Morell | |
| 5,996,885 | A | | 12/1999 | Chu | |
| 6,012,587 | A | | 1/2000 | McCullough | |
| 6,016,904 | A | | 1/2000 | Hammock | |
| 6,471,124 | B1 | | 10/2002 | Tedeschi | |
| 6,675,970 | B1 | | 1/2004 | Nemoto | |
| 7,100,811 | B2 | | 9/2006 | Pettersson | |
| 7,121,453 | B2 | | 10/2006 | Nass | |
| 7,565,998 | B2 | * | 7/2009 | McClure | 206/591 |
| 7,726,489 | B2 | | 6/2010 | Li | |
| 7,913,896 | B2 | | 3/2011 | Reinkensmeyer | |
| 8,256,620 | B2 | * | 9/2012 | Kiessner et al. | 229/191 |
| 2002/0011171 | A1 | | 1/2002 | Usui | |
| 2005/0121356 | A1 | | 6/2005 | Wisecarver | |
| 2005/0211600 | A1 | | 9/2005 | Saito | |
| 2007/0145664 | A1 | | 6/2007 | Sardella | |
| 2007/0199648 | A1 | | 8/2007 | Hulverscheidt | |
| 2010/0155290 | A1 | | 6/2010 | Kiessner | |
| 2011/0272312 | A1 | | 11/2011 | Kramer | |

FOREIGN PATENT DOCUMENTS

| | | |
|---|---|---|
| EP | 1870341 | 12/2007 |
| FR | 2813584 | 3/2002 |
| GB | 2079802 | 1/1982 |
| JP | 11-157569 | 6/1999 |
| KR | 20-0251839 | 11/2001 |

OTHER PUBLICATIONS

Instructables, "Build a Cardboard Box", http://www.instructables.com/id/Build-A-Cardboard-Box/, available at least as early as Jan. 1, 2008.

Custom Packaging Options, Inc. "Custom Corrugated Cardboard Boxes", http://packaging.got-boxes.com/category/custom-corrugated-cardboard-Boxes-3.

eHow.com "How to Make Custom Cardboard Box Sizes", http://www.ehow.com/how_5656898_make-custom-cardboard-box-Sizes.html, date unknown.

Ponoko, "Large Cardboard Box—No Glue", http://www.ponoko.com/design-your-own/products/large-cardboard-box-no-glue-6102, Jul. 20, 2011.

International Search Report and Written Opinion from PCT/US2010/031017 dated Jun. 28, 2010.

International Search Report and Written Opinion from PCT/US2009/049602 dated Aug. 25, 2009.

International Search Report and Written Opinion from PCT/US2009/065552 dated Nov. 23, 2009.

International Search Report and Written Opinion from PCT/US2009/064477 dated Nov. 13, 2009.

International Search Report from PCT/US2009/064248 dated Dec. 29, 2009.

International Search Report and Written Opinion from PCT/US2010/022983 dated Feb. 3, 2010.

International Search Report from EP 09808706 dated Feb. 16, 2012.

U.S. Appl. No. 11/942,355, Mailed Sep. 10, 2010, Notice of Allowance.

U.S. Appl. No. 11/942,355, Mailed Jun. 17, 2009, Office Action.

U.S. Appl. No. 11/942,355, Mailed Mar. 16, 2010, Office Action.

U.S. Appl. No. 12/648,211, Mailed Dec. 1, 2011, Office Action.

U.S. Appl. No. 12/648,211, Mailed May 2, 2012, Notice of Allowance.

International Search Report and Written Opinion from PCT/US2009/054147 dated Aug. 18, 2009.

* cited by examiner

BOX TEMPLATE WITH INTEGRATED CORNER PROTECTORS

CROSS-REFERENCE TO RELATED APPLICATIONS

This application claims priority to and the benefit of U.S. Provisional Patent Application No. 61/089,991, filed Aug. 19, 2008, entitled BOX TEMPLATE WITH INTEGRAL CORNER PROTECTORS, which is incorporated herein by reference in its entirety.

BACKGROUND OF THE INVENTION

1. The Field of the Invention

Exemplary embodiments of the invention relate to packaging, and more particularly to the packaging of items within a box. Still more particularly, embodiments relate to packaging of an item within a box, with the box having a template formed to provide integrated corner protectors and/or spacers to protect the packaged item.

2. The Related Technology

In many industries, packaging materials are used to deliver products to clients. Generally speaking, the materials to be delivered are placed directly in a box. Such boxes may, of course, be of virtually any size and configuration. It may be that the product is placed directly inside the box without any additional protection. In other cases there may be some additional protection or cushioning provided. For instance, foam peanuts, bags of air, bubble-wrap, and the like may be used to protect a fragile or other product.

When an item is placed directly inside of a box, care is often taken to dimension the box so that the item fits snugly within the box. Such may be desirable to prevent excess movement of the item and, consequently, reduce the shaking or movement of the item therein. To ensure a tight fit, various materials are often placed around the item. For instance, Styrofoam sheets of various sizes may be placed along the sides of the item to cause a snug fit with the sides of the box.

During handling (e.g., transit) the box may become damaged. If the damage is sufficiently severe, the item inside the box may also become damaged. During such handling, the corners of a box, and thus the corners of the item in the box, are particularly vulnerable to damage. Accordingly, companies shipping a product will often place additional protection within the corners of the box. For instance, as shown in FIGS. 1 and 2, various types of corner protectors may be used.

In each instance, corner protectors are formed of a separate material (e.g., Styrofoam, cardboard, etc.) and such protectors are placed in the corners of the box. Specifically, the packaged item abuts the internal side of such protectors, and the internal side of the box is positioned adjacent the exterior side of the protector.

While such corner protectors are useful in the protection of an item packaged within a box, they also require the purchase of additional materials. Some companies may, therefore, forego the use of such corner protectors in order to reduce cost. Additionally, the use of such protectors will require some separate storage apart from the boxes themselves, thereby increasing the space requirement necessary for the storage of all shipping and/or packaging supplies.

BRIEF SUMMARY OF THE INVENTION

Exemplary embodiments of the invention relate to the packaging of items within boxes. Still more particularly, embodiments relate to packaging of items within boxes, which boxes are formed from a template that includes corner protectors integrated with the sheet used to form the box template.

According to one example, a cardboard box template is cut from a sheet of cardboard and defines a foldable box having at least four side surfaces, a top surface, and a bottom surface. The box template also includes a definition of corner protector sections integrally formed with the foldable box and configured to be folded to protect an item placed inside the foldable box. For instance, the top surface and bottom surface may each include at least two surfaces that are integrally formed with, and connected to, two of the side surfaces. The corner protector sections may be integrally formed with, and connected to, the one or both of the other two sides of the four side surfaces. Each of the corner protector sections may be configured to be folded into two corner protectors. For example, the corner protector sections may define two, four, six, or eight corner protectors.

More particularly, the box template may be integrally formed from a sheet of material (e.g., cardboard) by making various cuts and/or forming various creases in the sheet of material. For example, cuts and creases may be formed to define twelve rectangles which form the sides, top, and bottom of the foldable box, as well as one or more integrated corner protector sections. In addition to the twelve rectangles, a glue flap may also be formed in the box template to facilitate assembly of the box template into a box. The twelve rectangles can be arranged in a three-row, four-column pattern. The four rectangles that define the middle row can be folded to form the sides of the box. Similarly, the rectangles in the top and bottom rows can be folded to form the top and bottom of the box. Furthermore, one or more of the rectangles in the top and bottom rows can form the one or more integrated corner protector sections.

The corner protector sections themselves may be made from one, two, three, or four surfaces, each of which defines two corner protectors. Each corner protector may be formed from six rectangles which are arranged in a two-by-three pattern. For example, the pattern may be two rectangles high and three rectangles wide. In one embodiment, a right corner protector may include upper right, middle, and left rectangles, as well as lower right, middle, and left rectangles. The left corner protector may have a mirrored copy of the right corner protector.

In forming the corner protector, the upper-right rectangle may be connected to the lower-right and upper-middle rectangles, but separately distinguished by a crease line. Similarly, a crease line may distinguish between the upper-middle rectangle and the lower-middle and upper-left rectangles. The upper-left rectangle can be distinguished from the lower-left rectangle due to a cut, while the lower-middle rectangle is separated from the lower-left and lower-right rectangles by respective crease lines. The left corner protector and right corner protector of the four surfaces may also be separated by a cut extending between the left rectangles of the right corner protector and the right rectangles of the left corner protector. A lateral portion that extends the width of an adjacent side surface may also connect to each of the left and right corner protectors. For instance, a crease line may separate the lateral portion from the lower-right rectangle of the right corner protector (and from the lower-left rectangle of the left corner protector), while a cut separates the lateral portion from the lower-middle and left rectangles of the right corner protector (and from the lower-middle and right rectangles of the left corner protector).

Each of the one or more corner protector sections integrally formed with the box template can be folded and inserted into the box created with the box template to provide increased protection to items packaged within the box. The corner protectors can provide uniform protection to the corners of an item packaged within the box. Additionally, each of the corner protectors can be folded and inserted into the box after an item is placed in the box. Moreover, the corner protectors can be integrally formed with the box template in such a manner that no additional material is used to form the box with integrated corner protectors compared to a similar type box without corner protectors.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein extend to methods, devices, systems, assemblies, and apparatus for packaging objects. Such are configured to, for example, allow corner protectors to be inserted around an item placed within a box, without requiring a separate corner protector be installed or procured.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be obvious, however, to one of ordinary skill in the art that the present invention may be practiced without these specific details. In other cases, well known aspects of packaging materials, boxes, and general manufacturing techniques are not described in detail herein in order to avoid unnecessarily obscuring the novel aspects of the present invention.

Figure 1:
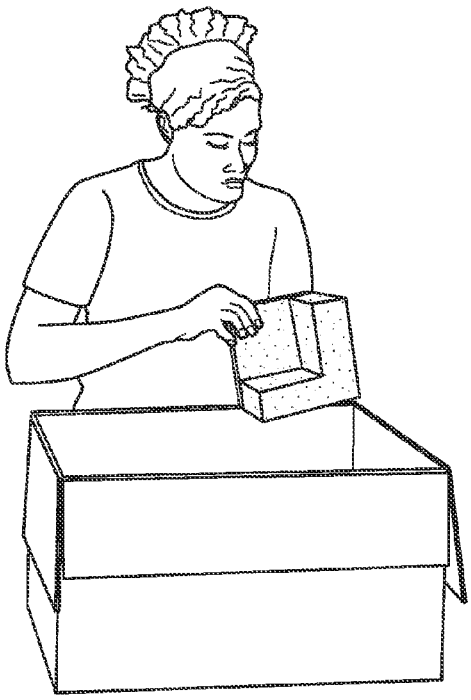
FIG. 1 (Prior Art)
FIG. 1 illustrates an example external corner protector that is separate from the boxes with which it is used, and which are made of a polymeric material.
Figure 2:
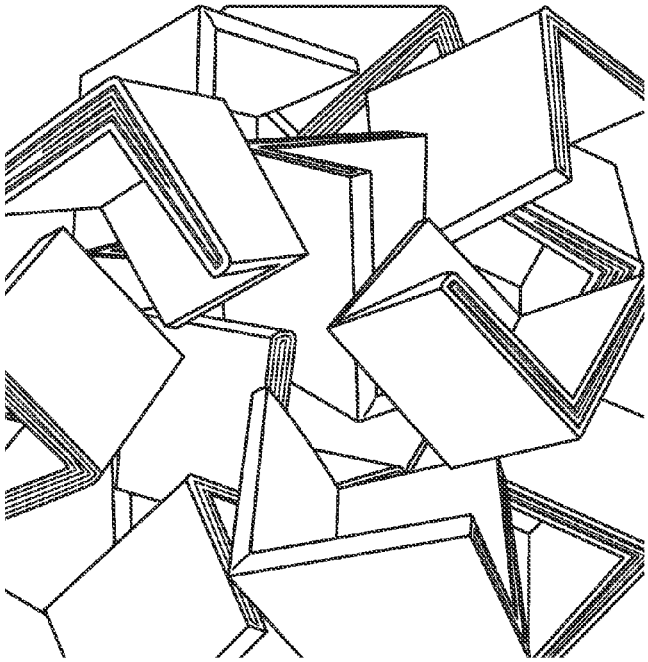
FIG. 2 (Prior Art)
FIG. 2 illustrates other external corner protectors which are separate from the boxes with which they are used, and which are made of cardboard.
Figure 3:
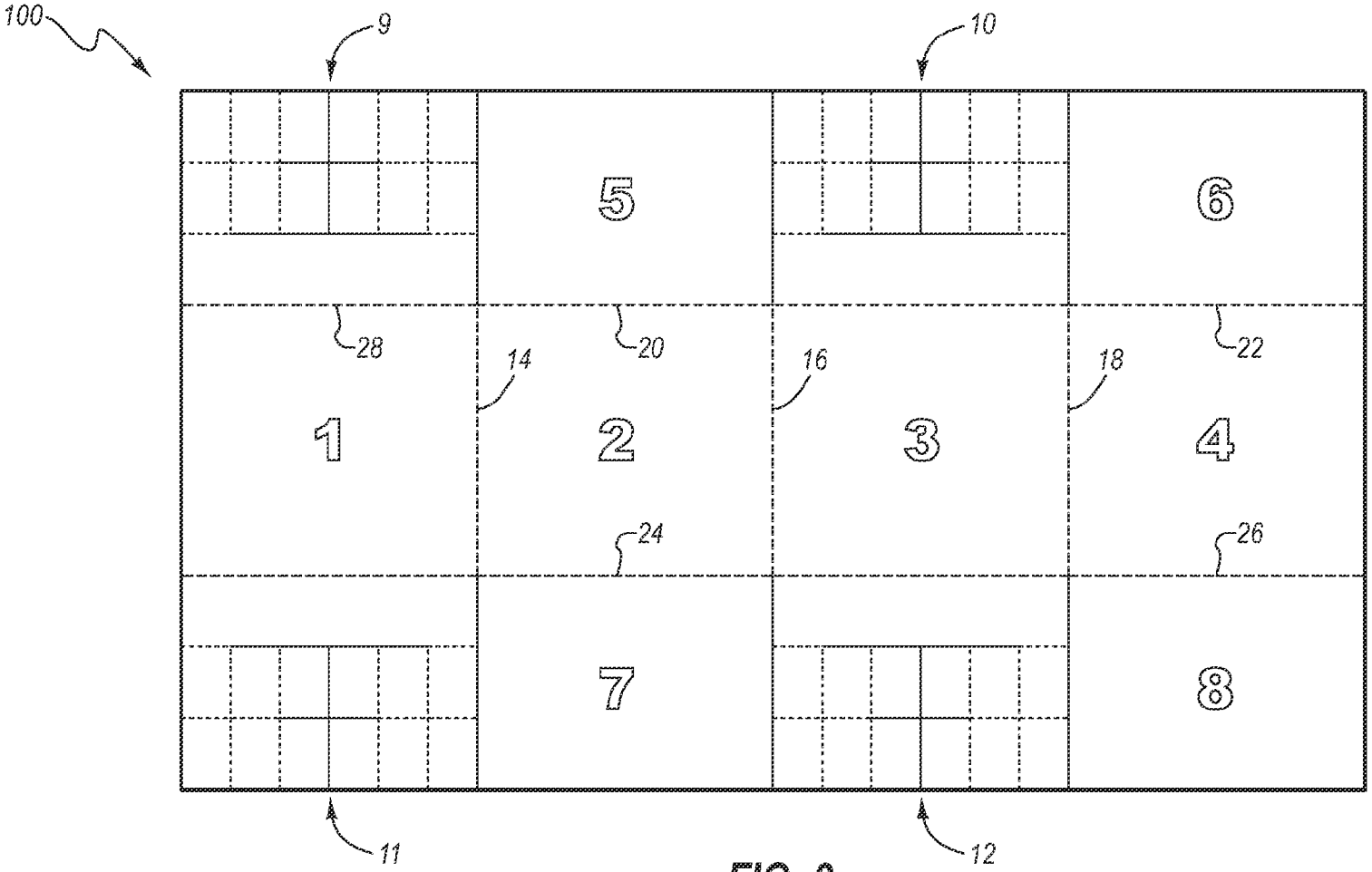
FIG. 3 illustrates a box template for a box having four sides, a top, and a bottom, along with four integrated corner protector sections that form eight corner protectors.

FIG. 3 and the following discussion are intended to provide a brief general description of an exemplary box template which can be used according to aspects of the present invention, and which can include corner protectors which are integrated with the box template. While a box template with integrated corner protectors is described below with respect to cardboard boxes, this is but one single example, and embodiments of the invention may be implemented with boxes formed of other types of materials, and with boxes of varying sizes and configurations. Accordingly, throughout the specification and claims, the term "box" is intended to apply broadly to any type of packaging container or material used to enclose objects.

FIG. 3 illustrates an example box template 100 that can be formed from a rectangular sheet of cardboard or other material. As will be noted, the drawing illustrates twelve rectangles or sections, identified by references numbers 1-12. As will be discussed in greater detail below, section 1-8 are used to form the sides, top, and bottom of a box, while sections 9-12 are used to form corner protectors for the corners of the box formed by the illustrated box template 100. It will be understood that not all of sections 9-12 are required to be formable into corner protectors. Rather, one or more of sections 9-12 can be configured to form corner protectors, while the remaining sections of sections 9-12 can be used to form the top and/or bottom of the box.

As illustrated in FIG. 3, the various rectangles, while integrally formed of a common sheet of material, are separately identifiable as they are separated by a series of lines. In the illustrated figures, dashed lines are used to represent crease lines. In contrast, solid lines between rectangles illustrate cuts between the rectangles.

As will be appreciated, a box template 100 such as that illustrated in FIG. 3 can be made to form a box of substantially any size. For example, according to one embodiment, the box that is formable from the illustrated template 100 is approximately 20"×20"×20". To form a box of such a size, for example, sections 1-4 may each be squares that are approximately 20"×20". In some cases, to account for the space of creases, the sections may be made slightly larger so that the interior of the box is 20"×20"×20".

To use box template 100 to form a box, box template 100 is folded along the illustrated crease lines between sections 1-8. More particularly, sections 1-4 may be folded along the crease lines 14, 16, and 18, respectively, between sections 1 and 2, sections 2 and 3, and sections 3 and 4 to form the sides of the box. Section 1 may then be secured to section 4 to form a square/rectangle shape. For example, section 1 may be attached to section 4 by way of one or more glue flaps that are integrally formed with, and/or connected to, one or both of sections 1 and 4. Alternatively, section 1 may be attached to section 4 without the aid of a glue flap.

As sections 1-4 are folded to form the sides of the box, sections 5 and 6 can form the top of the box, while sections 7 and 8 can form the bottom of the box. More specifically, section 5 can be folded relative to section 2 (along the crease line 20 between sections 2 and 5), and section 6 can be folded relative to section 4 (along the crease line 22 between sections 4 and 6) in order to form the top of the box. Similarly, section 7 can be folded relative to section 2 (along the crease line 24 between sections 2 and 7), and section 8 can be folded relative to section 4 (along the crease line 26 between sections 4 and 8) in order to form the bottom of the box. Of course, as space is relative to the positioning, sections 5 and 6 may form the bottom of the box and sections 7 and 8 may form the top of the box.

As with sections 1-4, sections 5-8 may also have any suitable size. For example, such sections may be integrally formed with corresponding side sections (e.g., section 5 is integrally connected to section 2), and have a corresponding width (e.g., section 2 and section 5 may each be 20" wide). The height of sections 5-8 may be adjusted as desired. For instance, the height of sections 5-8 may be approximately half that of the side sections 1-4. Alternatively, such as illustrated in FIG. 3, sections 5-8 may have a height greater than half the height of side sections 1-4. In particular, in the illustrated embodiment the heights of sections 5-8 are approximately 75% of the height of side sections 1-4. Of course, in other embodiments, sections 5-8 may have lesser or greater heights than those described herein.

The remaining four sections 9-12 (i.e. the sections above and below sections 1 and 3) are, in this embodiment, configured to be folded and positioned inside the box, such that when the box is formed from the illustrated template 100, they will be positioned inside the side walls formed by sections 1-4, and inside the top and bottom surfaces formed by sections 5-8. More particularly, these additional four sections 9-12 can be folded to form eight corner protectors which can fit at the four corners of the bottom surface and the four corners of the top surface formed by the illustrated box template 100. As will be appreciated, the additional four sections 9-12 may have a size generally corresponding to the size of the top and bottom sections 5-8, although this is not always necessary. As noted herein, one or more of section 9-12 can be used to form at least a portion of the top and/or bottom of the box rather than forming corner protectors. Thus, a box template according to the present invention can include one, two, three, or four corner protector sections, such as sections 9-12, which can be configured to form two, four, six, or eight corner protectors, respectively.

Figure 4:
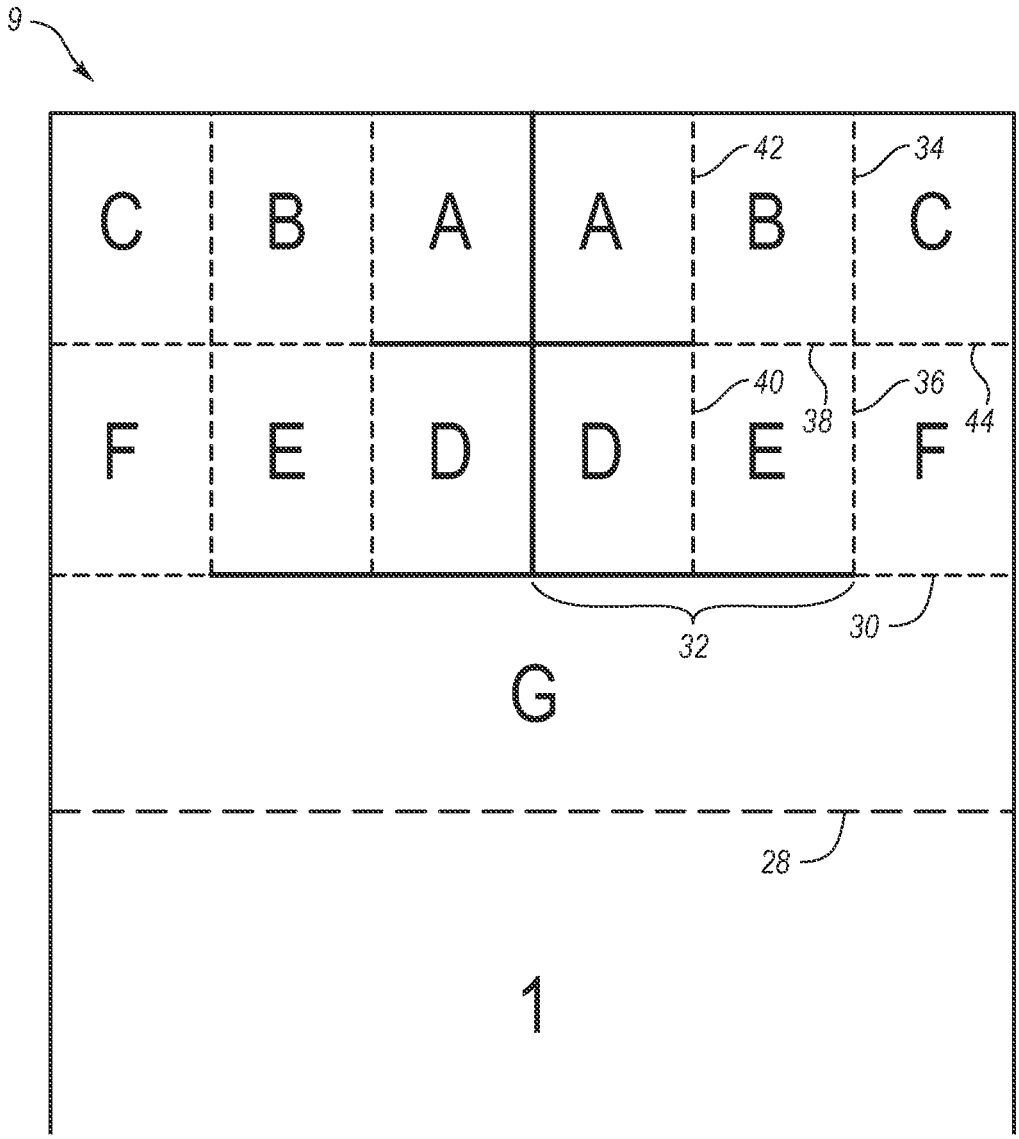
FIG. 4 illustrates an enlarged view of one of the integrated corner protector sections of FIG. 3.

Turning now to FIG. 4, an enlarged view of sections 9 is illustrated. As can be seen, the illustrated corner protector section 9 includes thirteen rectangles that are independently identifiable thereon. Specifically, a connection section G extends laterally along the width of this section and, as shown in FIG. 4, is attached to one of the side sections (e.g., section 1) of the box template 100 at an interface 28 along which it can be folded. Two sets of six additional rectangles (each including rectangles A-F) are then connected to, and extend outwardly from, lateral section G. As will be described in greater detail herein, each group of rectangles A-F is configured to form one corner protector.

As can be seen in the illustrated embodiment, each of rectangles A-F are integrally formed from the sheet of material, but are separately identifiable by either a crease line (dashed line) or a cut (solid line). Additionally, a cut is formed between the two sets of six rectangles so as to allow them to be folded independently.

The illustrated embodiment is merely one example of how corner protectors may be formed, and the rectangles can have numerous sizes and configurations. Indeed, in other embodiments there may be different numbers of rectangles. For instance, in the illustrated embodiment, each of rectangles A-F may have approximately the same size (e.g., 3.33"×5"), although such is not necessary. For instance, in one embodiment rectangles C and F have a width slightly less than a width of rectangles A, B, D and E. In another embodiment, rectangle A and D have a width slightly larger than a width of rectangles B, C, E and F. Furthermore, it is not necessary that rectangles A-C, D-F, and/or G have the same height. For instance, rectangles A-C may have a height that is somewhat less than the height of rectangles D-F and/or G. For instance, rectangles D-G may have a height of about 5", while rectangles A-C have a height of about 4.5".

Turning now to FIGS. 5-9, an exemplary manner of folding a corner protector is illustrated in greater detail. The illustrated embodiment show only one corner protector (i.e., rectangles A-G) so as to more clearly illustrate various exemplary manners in which the corner protector can be created from rectangles A-G. In these illustrations, the corner protector may be referred to as the right corner protector, while the left corner protector is omitted for clarity. Of course, inasmuch as the box template 100 can be moved and viewed at other angles, the corner protector may also be a left corner protector from some perspectives, while the right corner protector is omitted.

Figure 6:
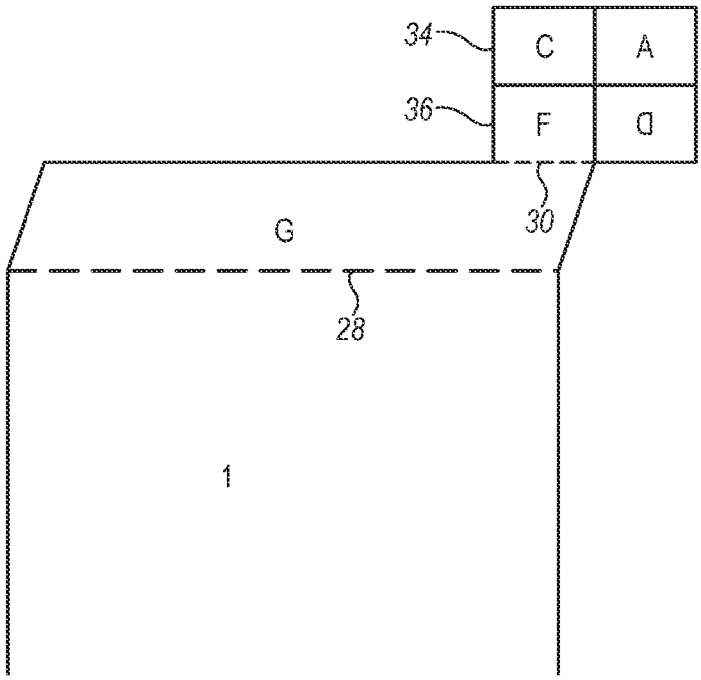
Figure 7:
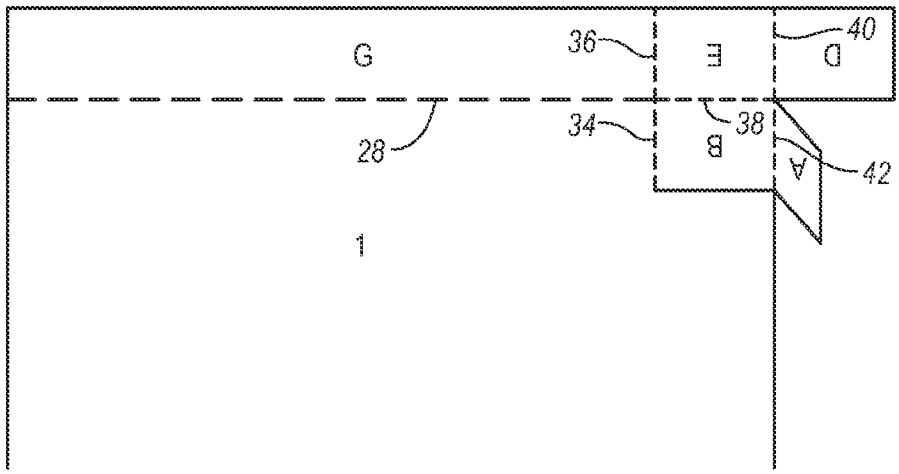

As will be described below, the corner protectors can be formed with a series of folds so as to reposition rectangles A-G relative to one another. FIGS. 5-9 illustrate various exemplary folding actions that can be used to create corner protectors. In an effort to clearly illustrate the various folding actions, the orientation of the alphabetic identifiers for each of rectangles A-G changes as the orientation of the rectangles change. For instance, the alphabetic identifiers (A-G) in FIG. 4 are all oriented in an upright manner, indicating that each of rectangles A-G are oriented uprightly. In FIGS. 5-9, the alphabetic identifiers may be inverted or otherwise oriented to illustrate the orientation of the corresponding rectangle relative to the other rectangles. For example, the letters A, B, D, and E in FIG. 7 are inverted to illustrate these rectangles have been folded so that they are inverted relative to rectangle G.

Figure 5:
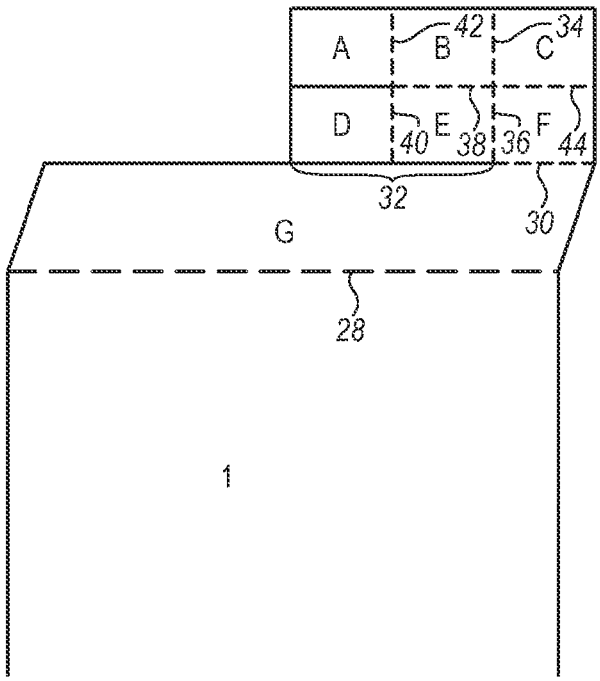
FIGS. 5-9 illustrate exemplary steps in forming a corner protector from the box template of FIG. 3.

With respect to FIG. 5, there is shown a corner protector which is attached to and extends from side section 1. The portion of section 1 that is viewable in FIG. 5 is the inner surface, or the surface that is on the interior of the box. Rectangle G has been folded along interface 28 toward the outer surface of section 1. Additionally, rectangles A, B, D, and E have been collectively folded as a group along crease lines 34 and 36 between rectangles B and C, and E and F, respectively. More particularly, rectangles B and E have been folded over the crease lines 34 and 36 so that such rectangles are positioned directly behind rectangles C and F. It will be appreciated that rectangles B and E can alternatively be folded over crease lines 34 and 36 so that such rectangles are positioned directly in front of rectangles C and F.

Turning now to FIG. 7, the next steps in the folding process are illustrated. Specifically, rectangles A-F have been collectively folding down so that rectangle F (which is behind rectangle E) lies against rectangle G and rectangle C (which is behind rectangle B) lies against the interior surface of section 1. More specifically, rectangle F has been folded, relative to rectangle G, over crease line 30 to facilitate the described positioning of the rectangles. With rectangles A-F so folded, rectangles A, B, D, and E are viewable and appear inverted, while rectangles C and F are positioned behind rectangles B and E, respectively. In addition, rectangle A has been folded along crease line 42 so that rectangle A forms a generally right angle with rectangle B and lies against the interior surface of side section 2 (not shown).

Figure 8:
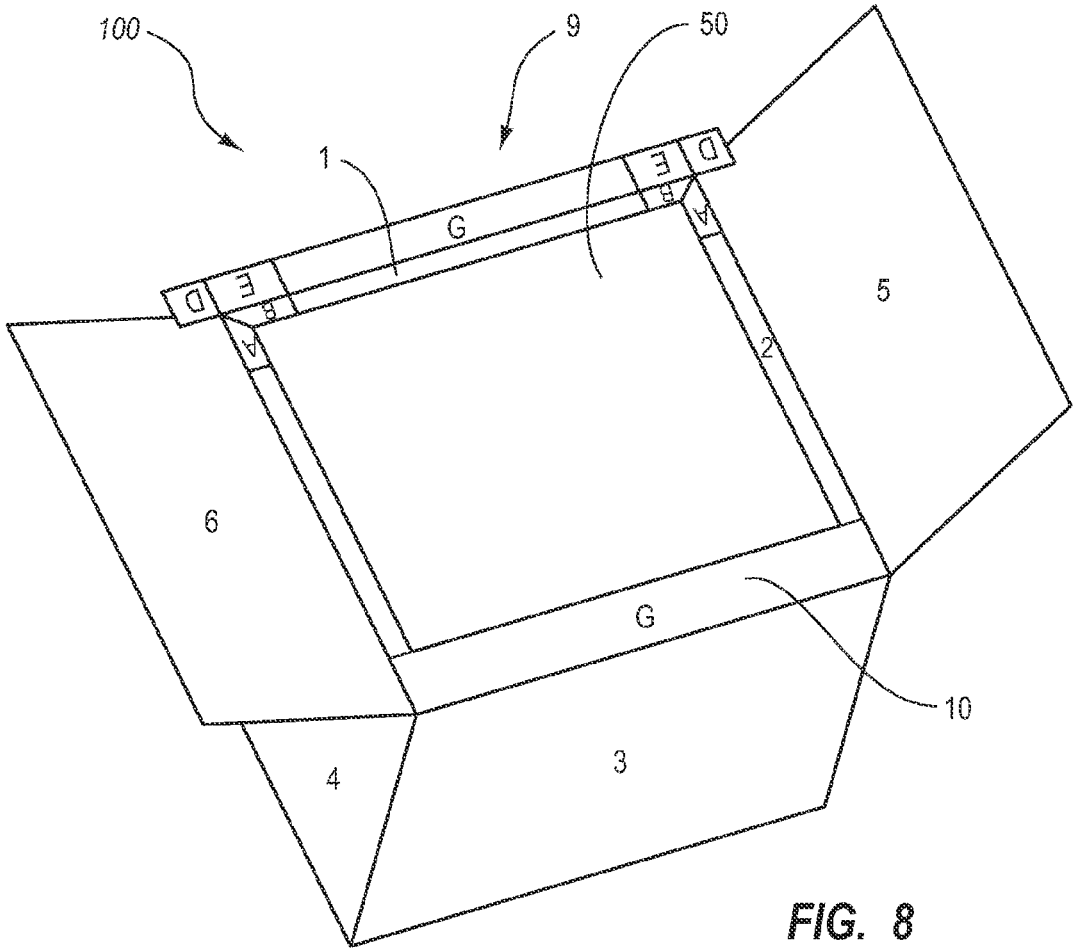

Notably, this folding process enables the corner protector to be formed after an item has been placed into the box formed by box template 100. In particular, once rectangles A-G have been folded as shown in FIG. 6, rectangle A can be folded long crease line 42 as described, and rectangles A-C can be inserted into the box between the interior surfaces of the box and an item 50 that has already been placed in the box, as illustrated in FIG. 8. More specifically, while rectangles A-F are folded along crease line 30 as described, rectangles A-C can be inserted into the box and between the interior surfaces of the box and an item 50 that is positioned within the box. To facilitate the insertion of rectangles A-C between the interior surfaces of the box and the item 50 positioned within the box, it may be helpful to fold rectangle C toward rectangle F along crease line 44. Folding rectangle C in this manner will understandably cause rectangle B to fold along crease line 38.

While the above discussion has focused on the creation of one corner protector, each of sections 9-12 can be configured to form two or more corner protectors. For instance, as illustrated in FIG. 8, section 9 has been folded to form two corner protectors. One of the corner protectors is located near the corner of the box formed by sections 1, 2, and 5, while the other corner protector is located near the corner of the box formed by sections 1, 4, and 6. It will be appreciated that sections 10-12 can form similar corner protectors for the other six corners of the box created using box template 100.

Figure 9:
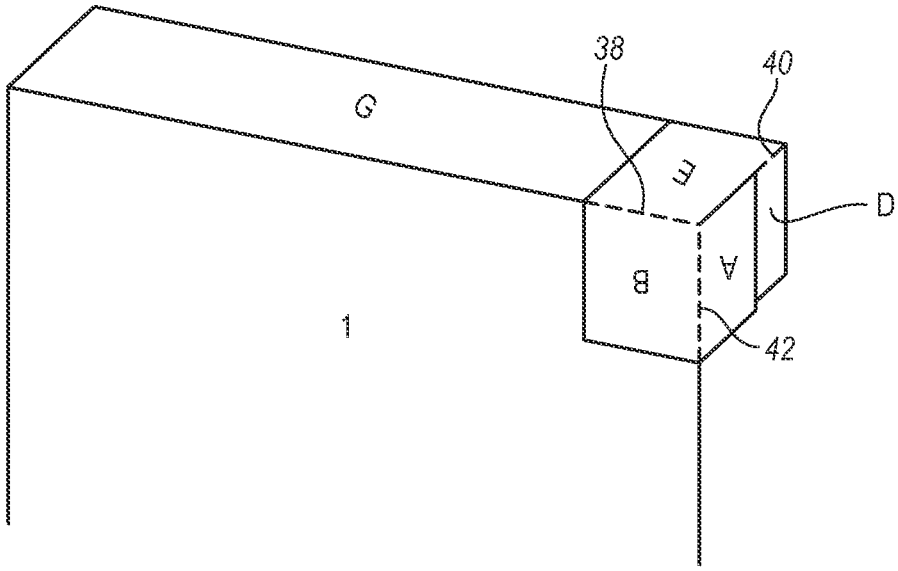

Once rectangles A-C have been inserted into the box, the final steps in folding the corner protector can be completed as illustrated in FIG. 9. In particular, rectangle D has been folded about ninety degrees along the crease line 40 between sections D and E. In addition, section G has been folded along crease line 28 toward the interior surface of side section 1 so as to form a generally right angle with side section 1. Folding section G in this manner also causes rectangle E to fold along crease line 38 so that rectangle E forms a generally right angle with rectangle B. It will be appreciated that the positioning of rectangle F between section G and rectangle E will cause rectangle F to fold along crease line 44 when section G is folded to form a generally right angle with section 1. Furthermore, the folding of section G also causes rectangle D to be positioned adjacent rectangle A within the box. In the illustrated case, rectangle D is positioned outside of rectangle A, although in other cases it may just as easily be positioned inside rectangle A. Furthermore, the entire corner protector has been rotated back to provide an interior look at the corner protector such that the underside of rectangle E can now be viewed.

The above described and illustrated manner and process for folding the integrated corner protectors is merely exemplary. The corner protectors of box template 100 can be folded and formed in other manners without departing from the scope of the present invention. For instance, the corner protectors can be formed by first folding section G into the box so that is lies generally against one of the side surfaces of the box and then folding rectangles A-F in a similar manner as described above. Folding section G into the box first can provide yet an additional layer of protection to one surface of an item packaged within the box. This may be desirable when the front surface of an item needs greater protection than the top, sides, or bottom of the item.

Figure 10:
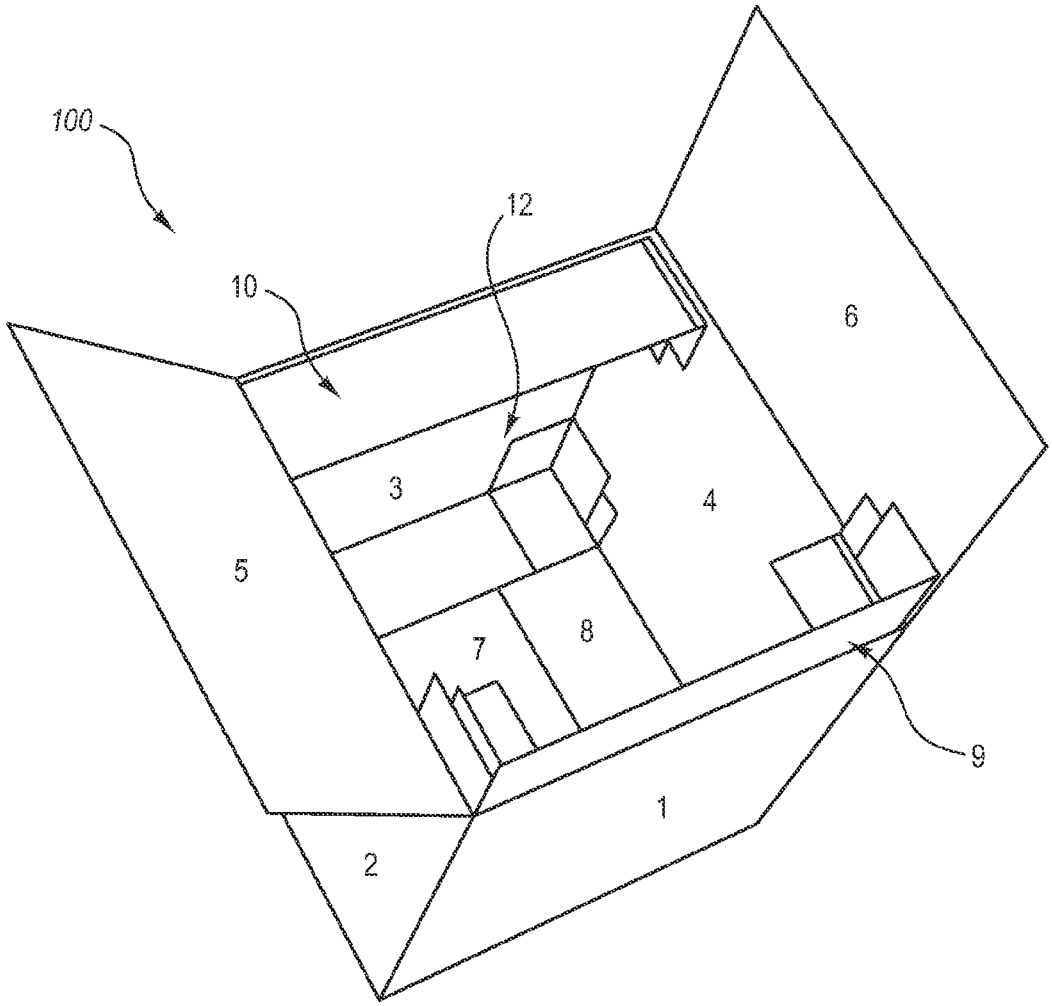
FIG. 10 illustrates the box template of FIG. 3 in which the box template has been folded into a box and the integrated corner protectors have been folded to provide protection to an item placed within the box.

As noted previously, FIGS. 5-10 illustrate only one corner protector, although two corner protectors are illustrated in FIGS. 3, 4, and 8 as being formed on each of sections 9-12. With respect now to FIG. 10, the use of such corner protectors can be seen in greater detail. Specifically, FIG. 10 illustrates the box template 100 of FIG. 3 when it has been folded as described previously (i.e., the side sections 1-4 have been folded and section 1 connected to section 4, while the bottom sections 7 and 8 have been folded to overlap and enclose the bottom). Furthermore, the additional corner protector sections 9-12 have all been folded to form their respective corner protectors. In the perspective view illustrated, for instance, one of the two corner protectors formed by section 12 is shown in a bottom corner of the box (e.g., the corner formed by sections 3, 4, and 8). As will be appreciated, equivalent corner protectors that are integrally cut in the box template 100 may also be positioned at each of the other three corners of the box bottom.

Additionally, above side section 3, two corner protectors have been formed from section 10 and folded down into the box. It can be easily seen that when such are folded down, when a box is inserted therein, the corner protectors can provide additional support between the corners of an item 50 and the illustrated box template 100. The two corner protectors formed from section 9 and positioned above side section 1 are also illustrated. These corner protectors are currently not folded down so as to illustrate the relative positioning of rectangles A-F when the corner protector is folded together. It will be appreciated the these corner protectors can also be folded down to a position similar to the other top corner protectors formed from section 10 to enclose an item 50.

Figure 11:
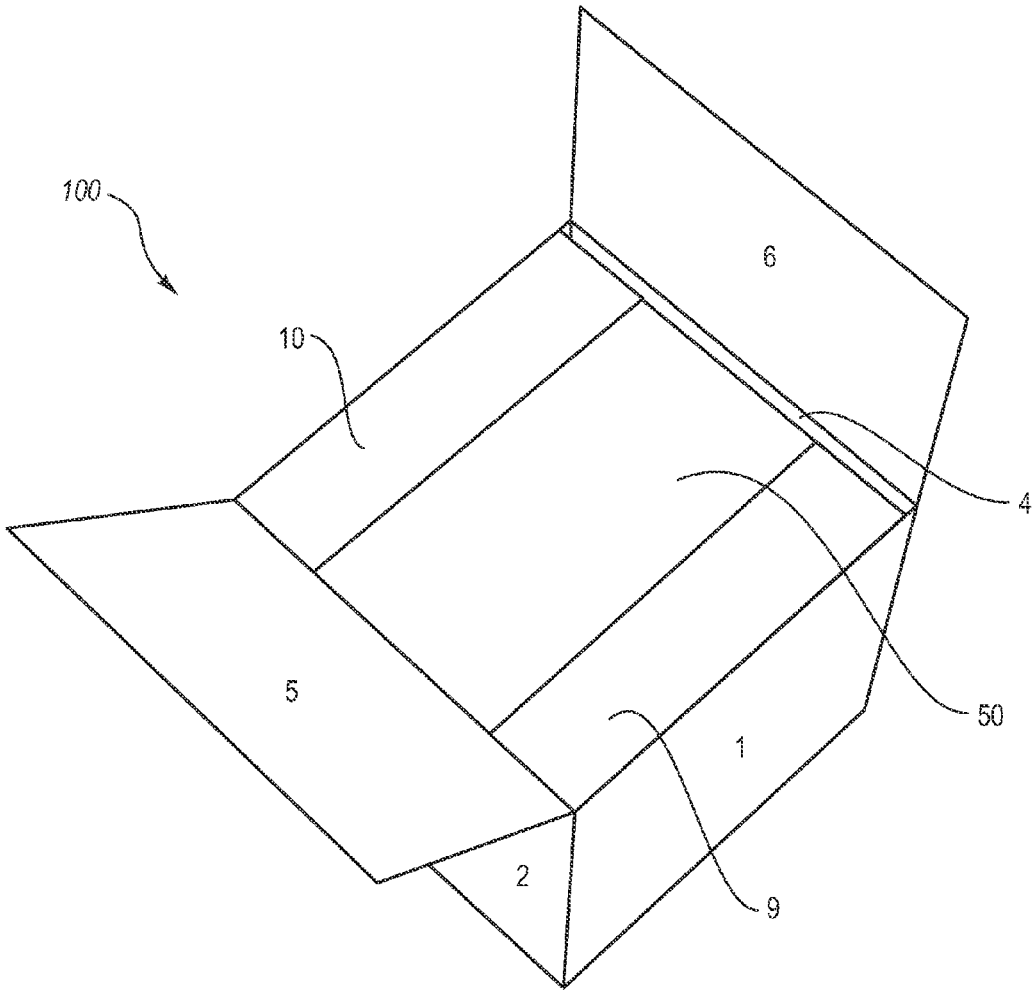
FIG. 11 illustrates the box template of FIG. 3 in which the integrated corner protectors have been positioned around an item that is within the folded box template.

More specifically, as illustrated in FIG. 11, the corner protectors can be folded to provide corner protection to an item 50. Specifically, in the illustrated embodiment, an item 50 is illustrated as being enclosed within the now folded box template 100, and having the corner protectors disposed between the exterior surface of the item 50 and the interior surface of the box.

The corner protectors as described above provide many advantageous. For instance, the corner protectors are integrally formed with the box template, and thus additional or separate corner protectors are not needed. Furthermore, the corner protectors can be formed out of what are typically referred to as the major and/or minor flaps of a box. That is, a box template typically has four side sections, four major flaps, and four minor flaps. The major and minor flaps are commonly used to form the top and bottom of the box. In the present invention, one or more of the major and/or minor flaps (typically the minor flaps) are used to form the corner protectors described herein (e.g., sections 9-12). By forming the corner protectors out of one or more of the major and/or minor flaps, a box with integrated corner protectors can be formed without using any additional material over what would otherwise be used to form a box of similar type and size.

Furthermore, the box template 100 can be formed with one or more corner protector sections. That is, one or more of sections 9-12 can be cut/creased to form corner protectors, while the remaining sections of sections 9-12 can be left uncut/uncreased. The uncut/uncreased sections can be used to form at least a portion of the top and/or bottom of the box, as is done with a typical box. Providing one or more corner protector sections may be desirable when it is only necessary to provide additional protection to some of the corners of an item to be placed in a box. For example, it may be desirable to provide additional protection to the front of a cabinet or an appliance that is packaged within a box, while it is not as necessary to protect the back of the cabinet or appliance. In such a case, a box according to the present invention may be formed with only one or two corner protection sections (e.g., 9 and 11) while the other sections (e.g., 10 and 12) are used as part of the top and bottom of the box. Thus, a box with integrated corner protectors according to the present invention may be formed with one, two, three, or four corner protector sections.

Another advantageous feature of the present invention is that the corner protectors can be folded and inserted into the box even after an item has been inserted into the box. Thus, the corner protectors do not have to be formed and secured in place before an item can be packaged within the box. Rather, the item can be placed in the box and the corner protectors can be formed and inserted around the item. This provides the assurance that the corner protectors are properly positioned around the packaged item.

Additionally, each of the three sides of the box corner provides two additional layers of protection in addition to the layers typically provided by a box. In particular, the top side of the box corner has rectangles E and F, the side of the box corner adjacent section 1 has rectangles B and C, and the side of the box corner adjacent section 2 (section 2 not shown) has rectangles A and D which provide the two additional layers of protection for each side of the corner. Also, not only do the corner protectors provide additional layers of protection on each side of the corners, but the additional layers of protection are uniform. That is, each side of the corner has the same number of layers of added material, which provides greater stability and protection for items placed in the box.

Still further, the material used to form the corner protectors can be formed of or coated with a non-abrasive material. In some embodiments, the box is formed of a corrugated cardboard material that has one surface that is smoother, or has a smoother finished applied thereto. The corner protectors can be folded such that one or more of the three surfaces that are formed by each of the corner protectors and that contact a packaged item are the non-abrasive/smoother surface. This can protect the packaged item from minor scratches that may otherwise be causes from rubbing against a more abrasive, not coated surface.

The invention is susceptible to various modifications and alternative means, and specific examples thereof have been shown by way of example in the drawings and are herein described in detail. It should be understood, however, that the invention is not to be limited to the particular devices or methods disclosed, but to the contrary, the invention is to cover all modifications, equivalents, and alternatives falling within the spirit and scope of the description and claims.

I claim:

1. A box template configured to be arranged into a box, the box template comprising:

at least four side surfaces that are adapted to be folded to form at least four sides of the box;

a top surface that is adapted to be folded to form a top of the box;

a bottom surface that is adapted to be folded to form a bottom of the box; and one or more corner protectors integrally formed with, and connected to, the box template and configured to be folded to protect an item placed inside the box, at least one of the one or more corner protectors is formed by a series of cuts and creases, and the at least one of the one or more corner protectors includes six rectangles arranged in a two-by-three pattern.

2. The box template of claim 1, wherein the top surface and the bottom surface are each composed of at least two surfaces, and wherein the at least two surfaces of the top surface are integrally formed with, and connected to, two of the at least four side surfaces, and wherein the at least two surfaces of the bottom surface are integrally formed with, and connected to, the same two of the at least four side surfaces.

3. The box template of claim 2, wherein the one or more corner protectors are integrally formed with at least one of the other two of the at least four side surfaces.

4. The box template of claim 1, wherein the one or more corner protectors define eight corner protectors.

5. The box template of claim 1, wherein each of the one or more corner protectors is formed by a series of cuts and creases, wherein each corner protector includes six rectangles arranged in a two-by-three pattern.

6. The box template of claim 1, wherein the corner protectors are formed from four surfaces, each of which defines two corner protectors.

7. The box template of claim 5, wherein a right corner protector includes upper-right, upper-middle, upper-left, lower-left, lower-middle, and lower-right rectangles in the two-by-three pattern.

8. The box template of claim 7, wherein:

the upper-right rectangle is separated from the lower-right and upper-middle rectangles by crease lines;

the upper-middle rectangle is separated from the lower-middle and upper-left rectangles by crease lines;

the upper-left rectangle is separated from the lower-left rectangle by a cut;

the lower-left rectangle is separated from the lower-middle rectangle by a crease line; and the lower-middle rectangle is separated from the lower-right rectangle by a crease line.

9. The box template of claim 8, wherein a left corner protector has a minor image of the right corner protector, and wherein the upper-left and lower-left rectangles of the right corner protector are separated from the upper-right and lower-right rectangles of the left corner protector, respectively, by a cut.

10. The box template of claim 9, wherein the left corner protector and the right corner protector are integrally connected to a respective side surface by a lateral portion.

11. The box template of claim 10, wherein the lower-left and lower-middle rectangles of the right corner protector are separated from the lateral portion by a cut, and wherein the lower-right rectangle is separated from the lateral portion by a crease line.

12. A foldable box template that is configured to be arranged into a folded box, the foldable box template comprising:

at least four side surfaces that are adapted to be folded to form four sides of said folded box;

a top surface that is adapted to be folded to form a top of said folded box, wherein the top surface is integrally formed with and extends from one of the at least four side surfaces;

a bottom surface that is adapted to be folded to form a bottom of said folded box, wherein the bottom surface is integrally formed with and extends from one of the at least four side surfaces; and one or more corner protector sections that are adapted to be folded and positioned within said folded box to protect an object placed within said folded box, wherein each of the one or more corner protector sections are integrally formed with and extend from one of the at least four side surfaces, wherein at least one of the one or more corner protector sections is formed by a series of cuts and creases, wherein the at least one of the one or more corner protector sections includes six rectangles arranged in a two-by-three pattern.

13. The foldable box template of claim 12, wherein the one or more corner protector sections comprises at least four corner protector sections.

14. The foldable box template of claim 13, wherein two of the at least four corner protector sections are integrally formed with and extend from a bottom portion of their respective side surfaces.

15. The foldable box template of claim 14, wherein two of the at least four corner protector sections are integrally formed with and extend from a top portion of their respective side surfaces.

16. The foldable box template of claim 12, wherein each of the one or more corner protector sections is configured to be folded into two corner protectors.

17. The foldable box template of claim 12, wherein each of the one or more corner protector sections comprises a plurality of cuts and a plurality of crease lines to facilitate folding of each of the one or more corner protector sections into a plurality of corner protectors.

18. A box template that is configured to be folded into a box, said box template having a plurality of identifiable sections that are arranged in first, second, third, and fourth columns, wherein said first column of said box template comprises:

a first middle surface that is configured to form a first side of said box, the first middle surface having first, second, third, and fourth edges; and first and second corner protector sections that are integrally formed with and extend from the second and fourth edges of the first middle surface, wherein each of the first and second corner protector sections is configured to be folded to form two corner protectors;

said second column of said box template comprises:

a second middle surface that is configured to form a second side of said box, the second middle surface having first, second, third, and fourth edges, wherein the first edge of the second middle section is integrally formed with and extends from the third edge of the first middle surface;

a first top surface that is configured to be folded to form at least a portion of a top of said box, wherein the first top surface is integrally formed with and extends from the second edge of the second middle surface; and a first bottom surface that is configured to be folded to form at least a portion of a bottom of said box, wherein the first bottom surface is integrally formed with and extends from the fourth edge of the second middle surface;

said third column of said box template comprises:

a third middle surface that is configured to form a third side of said box, the third middle surface having first, second, third, and fourth edges, wherein the first edge of the third middle section is integrally formed with and extends from the third edge of the second middle surface; and third and fourth corner protector sections that are integrally formed with and extend from the second and fourth edges of the third middle surface, wherein each of the third and fourth corner protector sections is configured to be folded to form two corner protectors; and said fourth column of said box template comprises:

a fourth middle surface that is configured to form a fourth side of said box, said fourth middle surface having first, second, third, and fourth edges, wherein the first edge of the fourth middle section is integrally formed with and extends from the third edge of the third middle surface;

a second top surface that is configured to be folded to form at least a portion of the top of said box, wherein the second top surface is integrally formed with and extends from the second edge of the fourth middle surface; and a second bottom surface that is configured to be folded to form at least a portion of the bottom of said box, wherein the second bottom surface is integrally formed with and extends from the fourth edge of the fourth middle surface wherein at least one of the corner protector sections is formed by a series of cuts and creases, and the at least one of the corner protector sections includes six rectangles arranged in a two-by-three pattern.

19. The box template of claim 18, wherein each of the first, second, third, and fourth corner protector sections comprises a plurality of crease lines and cuts to facilitate folding of each of the corner protector sections into two corner protectors.

20. The box template of claim 19, wherein each of the two corner protectors formed by each of the first, second, third, and fourth corner protector sections can be formed by a six step folding process.

* * * * *